US006739252B2

(12) United States Patent
Stephan et al.

(10) Patent No.: US 6,739,252 B2
(45) Date of Patent: May 25, 2004

(54) METHOD AND APPARATUS FOR REVERSING SHEET MATERIAL IN SHEET-PROCESSING MACHINES

(75) Inventors: Günter Stephan, Wiesloch (DE); Karl-Heinz Helmstädter, Heidelberg (DE); Eckart Frankenberger, Hamburg (DE); Hans-Peter Hiltwein, Waghäusel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/208,306

(22) Filed: Jul. 30, 2002

(65) Prior Publication Data

US 2003/0019377 A1 Jan. 30, 2003

(30) Foreign Application Priority Data

Jul. 30, 2001 (DE) ..... 101 37 208
Mar. 26, 2002 (DE) ..... 102 13 430

(51) Int. Cl.[7] ..... B41F 5/02

(52) U.S. Cl. ..... 101/230; 101/483; 101/409; 101/183; 271/276; 271/277

(58) Field of Search ..... 101/230, 409, 101/410, 483, 485, 183; 271/276, 277, 82

(56) References Cited

U.S. PATENT DOCUMENTS 3,537,391 A * 11/1970 Mowry ..... 101/183
3,654,861 A * 4/1972 Rudolph et al. ..... 101/183
4,015,522 A * 4/1977 Preuss ..... 101/230
4,018,161 A * 4/1977 Johne et al. ..... 101/231
4,165,689 A 8/1979 Giuiuzza
4,821,643 A * 4/1989 Wieland ..... 101/230
4,928,586 A * 5/1990 Kida ..... 101/230
4,930,414 A * 6/1990 Wirz ..... 101/183
5,335,597 A * 8/1994 Helmstädter ..... 101/485
5,365,846 A * 11/1994 Becker ..... 101/230
5,454,312 A * 10/1995 Helmstäedter ..... 101/230
5,762,333 A * 6/1998 Sugiyama et al. ..... 271/276
6,089,155 A 7/2000 Kemmerer et al.
6,089,157 A * 7/2000 Becker et al. ..... 101/230
6,254,094 B1 7/2001 Becker et al.
6,401,610 B1 6/2002 Becker et al.

FOREIGN PATENT DOCUMENTS

DE 26 33 183 C2 2/1977
DE 39 03 093 A1 8/1990
DE 44 24 968 C2 1/1996
DE 198 14 320 C1 4/1999
DE 198 33 901 A1 2/2000
DE 198 33 903 A1 2/2000

* cited by examiner

*Primary Examiner*—Eugene H. Eickholt
(74) *Attorney, Agent, or Firm*—Laurence A. Greenberg; Werner H. Stemer; Gregory L. Mayback

(57) ABSTRACT

A method and an apparatus for reversing sheet material in a sheet-processing machine having at least two printing units, a reversing drum with a gripper system, and an impression cylinder that can be operated as a storage drum in perfecting mode and to which a further gripper system for one edge of the sheet material is assigned. In perfecting mode, one of the edges of the sheet material is gripped at an angular offset before the transfer centerline between the reversing drum and the storage drum, before the edge of the sheet material fixed to the storage drum is released.

24 Claims, 6 Drawing Sheets

Prior Art Fig. 1

METHOD AND APPARATUS FOR REVERSING SHEET MATERIAL IN SHEET-PROCESSING MACHINES

BACKGROUND OF THE INVENTION

Field of the Invention

The invention relates to a method and apparatus for reversing sheet material in sheet-processing machines, such as sheet-fed printing presses, having a plurality of printing units disposed one behind another.

German Patent DE 26 33 183 C, corresponding to U.S. Pat. No. 4,165,689 to Giuiuzza, relates to an apparatus for reversing sheets in a multicolor rotary offset printing press. Such a press includes at least two printing units each having a plate cylinder, a transfer cylinder, and an impression cylinder, which are coupled together in terms of drive through circulating transmission elements. A reversing device associated with the transfer elements is provided, which includes a reversing cylinder having a gripper.

The gripper is driven and disposed such that the sheets that have already been printed on one side are gripped after they have passed a transfer cylinder and the sheets have been removed completely from a transfer device resting on the cylinder. The sheets printed on one side are gripped by a reversal mechanism, which acts at the trailing edge of the sheets, which, until this point, have still been held at the leading edge by the gripper of the reversing cylinder. As a result, these sheets are fed to the gripper of the transfer device again with the direction of advance reversed by a separate apparatus that can be configured as a swing gripper or as a table to which vacuum is applied.

German Published, Non-Prosecuted Patent Application DE 39 03 093 A1 discloses a sheet-reversing apparatus. According to such a solution of a sheet-reversing apparatus for in-line rotary printing presses, the impression cylinders of successive printing units are connected by at least one transfer drum. A storage drum is disposed downstream of a transfer drum, parallel to the recto printing sheet guidance. The sheet-reversing apparatus can be uncoupled from the rectoprint sheet guide cylinders during recto printing operation. Provided on a sheet-reversing apparatus is a format adjustment, which can be adjusted independently of the cylinders carrying sheets in recto printing.

German Published, Non-Prosecuted Patent Application DE 198 33 903 A1, corresponding to U.S. Pat. No. 6,401,610 to Becker et al., relates to a method for the transfer of a sheet trailing edge from an upstream cylinder of a sheet-fed rotary printing press. According to such a method for the transfer of the sheet trailing edge from a cylinder and its transfer to a gripper system of a reversing drum, a suction gripper is guided initially along the periphery of the cylinder until the suction gripper has securely gripped the sheet trailing edge. The trailing edge is then guided tangentially to the cylinder cover of the upstream cylinder into the periphery of the reversing drum, the sheet being tautened and end-compressed along a tangent to the cylinder. The sheet is then transferred under no tension to the gripper system of the reversing drum. A gear device used for such a purpose includes three drive systems that are coupled to one another and are controlled through stationary cams.

In single-drum reversing systems, in which the impression cylinder located upstream of the reversing drum acts as a storage drum in a perfecting mode (also referred to as a recto/verso mode or reversing mode), the storage length is not sufficient for a large-format sheet. Attempts have been made to peel the sheet material off the impression cylinder, according to a solution disclosed by German Published, Non-Prosecuted Patent Application DE 44 24 968, but problems have occurred with regard to in-register transfer of the sheet trailing edge. By placing pressure elements, attempts have been made to press onto the sheet, but this, in turn, entails problems with regard to smearing in the case of those sheets that do not have any print-free areas.

SUMMARY OF THE INVENTION

It is accordingly an object of the invention to provide a method and apparatus for reversing sheet material in sheet-processing machines that overcomes the hereinafore-mentioned disadvantages of the heretofore-known devices and methods of this general type and that turns large-format sheet material in register when the overall space is limited.

With the foregoing and other objects in view, there is provided, in accordance with the invention, a method for reversing sheet material having edges in a sheet-processing machine having at least two printing units, including the steps of providing a gripper system on a reversing drum associated with at least one of the printing units, providing an impression cylinder operable as a storage drum in a recto/verso mode, the storage drum having a recto printing side and an impression-cylinder-side gripper system, the storage drum and the reversing drum defining a transfer centerline therebetween, and gripping, in the recto/verso mode, one of the edges of the sheet material at an angle before the transfer centerline with a holding and lifting system disposed parallel to the recto printing side of the storage drum before an edge of the sheet material fixed to the storage drum is released by the impression-cylinder-side gripper system.

With the objects of the invention in view, there is also provided a method for reversing sheet material having edges in a sheet-processing machine having at least two printing units, including the steps of providing a gripper system on a reversing drum associated with at least one of the printing units, providing an impression cylinder operable as a storage drum in a recto/verso mode, the storage drum having a recto printing side and an impression-cylinder-side gripper system, the storage drum and the reversing drum defining a transfer centerline therebetween, gripping a given edge of the sheet material with the impression-cylinder-side gripper system, and gripping, in the recto/verso mode, a given edge of the sheet material at an angle before the transfer centerline with a holding and lifting system disposed parallel to the recto printing side of the storage drum before the given edge is released by the impression-cylinder-side gripper system.

The advantages of the solution according to the invention can primarily be seen in the fact that, as a result of the early gripping of the sheet material at one edge before it passes the transfer centerline, early opening of the holding systems of the storage drum that grip the sheet material can be brought about. Such a configuration ensures that sheet material needing a large storage length can assume a substantially extended position underneath the storage drum. This prevents the sheet material from being able to run into the pocket area between storage drum and the transfer cylinder upstream of the latter and being damaged.

The holding and lifting system disposed outside the reversing drum tensions the sheet before it is turned and transfers the sheet to the gripper system of the reversing drum. The configuration ensures that the sheet material is transferred in register to the reversing drum so that both sides of the sheet material can be printed with the same quality. The in-register gripping of the sheet trailing edge of the sheet material is ensured by the fact that, at the time that it is gripped, a frictional or positive connection between the holding and lifting system and the outer surface of the impression cylinder serving as a storage drum is produced.

In a development of the idea on which the invention is based, the trailing edge of the sheet material is attracted by suction to the circumference of the storage drum before reaching the transfer centerline and is tensioned in the circumferential direction. Gripping the sheet trailing edge of the sheet material in the tensioned state of the sheet material ensures its in-register gripping and transfer to the reversing drum downstream of the storage drum. In accordance with the method proposed by the invention, the edge of the sheet material fixed to the circumference of the storage drum is released before it reaches a pocket between the storage drum and a transfer drum upstream of the latter. The early release of the edge of the sheet material fixed to the storage drum permits the deflection of large-format sheet material, needing a great storage length, into the free space underneath the storage drum so that, during the reversing action, the material does not experience any contact with rotating and stationary printing-unit components.

The assumption of a substantially extended position of the sheet material is assisted by rotation of the gripper system of the reversing drum that, during the rotation of the reversing drum, holds the gripped edge of the sheet material substantially in the horizontal position.

In accordance with another mode of the invention, a trailing edge of the sheet material is held in a gripper closure before reaching the transfer centerline.

In accordance with a further mode of the invention, one of a form-fitting connection and a frictional connection is produced between the gripper closure and the impression cylinder.

In accordance with an added mode of the invention, a transfer drum is placed upstream of the storage drum with respect to a sheet material transport direction and an edge of the sheet material fixed on a circumference of the storage drum is released before reaching a pocket between the storage drum and the transfer drum. Preferably, the pocket is disposed between the storage drum and the transfer drum at a downstream side of the storage drum with respect to a sheet material transport direction.

In accordance with an additional mode of the invention, the gripper system of the reversing drum is rotated to transfer the trailing edge of the sheet material into a substantially extended position. Preferably, the sheet material assumes the substantially extended position underneath the storage drum.

With the objects of the invention in view, there is also provided an apparatus for reversing sheet material having edges in a sheet-processing machine, including at least two printing units, at least one of the printing units having a reversing drum having a gripper system, an impression cylinder operable as a storage drum when recto/verso printing, the storage drum having a recto printing side, a circumference, and an impression-cylinder-side gripper system, the storage drum and the reversing drum defining a transfer centerline therebetween, a holding and lifting system disposed parallel to the recto printing side of the storage drum, the holding and lifting system adapted to lift an edge of the sheet material off the circumference of the storage drum before the transfer centerline and to transfer the lifted edge into the gripper system of the reversing drum one of directly and along a path.

In accordance with yet another feature of the invention, the holding and lifting system lifts one edge of the sheet material from the circumference of the storage drum before the transfer centerline and transfers the edge, directly or along a path, into the gripper system of the reversing drum.

In accordance with yet a further feature of the invention, the system is constructed as a self-supporting bridge that circulates relative to the storage drum, of which one or more can be associated with the circumference of the impression cylinder functioning as a storage drum. The holding and lifting system according to the first variant of the solution according to the invention includes a driven swinging element that can be set cyclically against the outer surface of the storage drum and that, at a distance $\phi$ before the transfer centerline between storage drum and reversing drum, has a holding element for gripping the sheet trailing edge of the sheet material accommodated on the storage drum. The holding element, in turn, includes a suction element that can be moved at right angles to the outer surface of the storage drum and with which the trailing edge of the sheet material in the circumferential direction on the storage drum can be tensioned in the radial direction and lifted off the outer surface of the storage drum. To assist the action of lifting the sheet trailing edge of the sheet material, at the moment it is gripped between the holding and lifting system and the impression cylinder functioning as a storage drum, a form-fitting or frictional connection is produced, it being possible to provide on the holding element a fixing element that can be displaced in the horizontal direction and is configured such that it can be moved into and out of the holding element. By such a displaceable fixing element in the holding and lifting system, it is possible to move under the sheet trailing edge of the sheet material lifted off the outer surface of the storage drum so that it is ensured that the sheet trailing edge of the sheet material, to be gripped in register, is gripped by the gripper system associated with the reversing drum in a tension and aligned state.

In accordance with yet an added feature of the invention, the holding element has a holding finger adapted to move under the trailing edge of the sheet and to lift off the trailing edge from the outer surface of the storage drum.

In accordance with yet an additional feature of the invention, the holding and lifting system is constructed substantially as a swinging gripper driven by an eccentric drive. The movement path of the swinging gripper relative to the storage drum or relative to the reversing drum is imposed by the eccentric drive, which executes two complete revolutions per 360° machine angle and substantially impresses onto the swinging gripper a movement path running in the shape of a loop. By the holding and lifting system disposed above storage drum and reversing drum according to this variant, the sheet trailing edge picked up from the outer surface of the storage drum is transferred in-register to the gripper system of the reversing drum. According to this variant, the holding and lifting system is moved out of the reversing drum and is constructed as a separate transfer system on the side of the printing unit for the sheet material to be turned.

In accordance with again another feature of the invention, the holding and lifting system can be constructed as a rotating pair of cylinders, on which a plurality of sucker/gripper systems are provided. By such a configuration of the holding and lifting system, the sheet trailing edge of the sheet material accommodated on the outer surface of the storage drum can be gripped early, before passing the transfer centerline, and can be transferred along a movement path from one transfer cylinder to the further transfer cylinders before it is gripped by the gripper system of the reversing drum. According to this variant, the transfer of the trailing edge of the sheet material to be turned is not carried out directly to the gripper system of the reversing drum but indirectly through the interposition of the holding and lifting system, constructed as a rotating pair of cylinders.

In accordance with again a further feature of the invention, the pair of cylinders include first and second transfer cylinders, the first transfer cylinder is adapted to pick up the trailing edge of the sheet from the outer surface of the storage drum and to transfer the trailing edge to the second transfer cylinder along a gripper path, and the second transfer cylinder is adapted to transfer the trailing edge to the gripper system of the reversing drum along the gripper path.

In accordance with a concomitant feature of the invention, the rotating cylinders of the pair of cylinders are constructed as a transfer cylinder equipped with a plurality of gripper and sucker system and, preferably, constructed as double disks, between which the sucker/gripper systems are accommodated as self-supporting bridge parts.

The method proposed according to the invention and the solution proposed according to the invention, in accordance with the variants illustrated, can preferably be used on sheet-processing multicolor rotary printing presses. If stiffer printing materials, such as board, or those materials requiring a large storage length during reversing, are processed on web-processing rotary printing presses having two and more printing units and downstream finishing or varnishing units, the use of the method proposed according to the invention and the apparatus proposed according to the invention permits smear-free in-register reversing to be achieved because the printing material to be turned is effectively protected against contact with printing-unit components accommodated in a stationary or rotating manner.

Other features that are considered as characteristic for the invention are set forth in the appended claims.

Although the invention is illustrated and described herein as embodied in an apparatus for reversing sheet material in sheet-processing machines, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
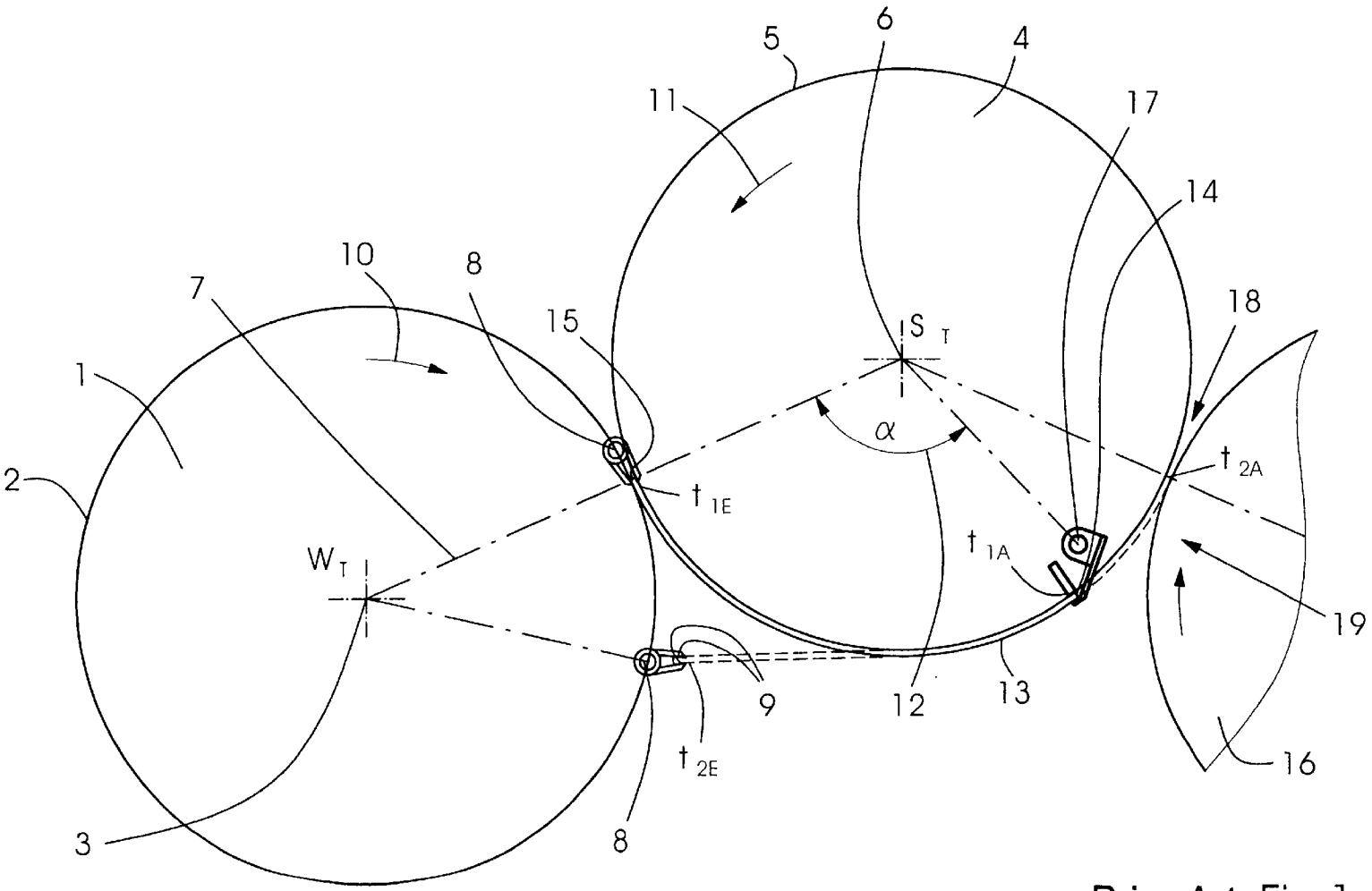
FIG. 1 is a fragmentary, diagrammatic, cross-sectional view of a single-drum reversing of sheet material during the transfer of the sheet trailing edge in the area of the transfer centerline according to the prior art.

Referring now to the figures of the drawings in detail and first, particularly to FIG. 1 thereof, there is shown the single-drum reversing of large-format sheet material with transfer of the sheet trailing edge in the area of the transfer centerline between storage drum and reversing drum.

Sheet material 13 is conveyed from a transfer drum 16 disposed upstream of a storage drum 4 to the outer surface 5 of the storage drum 4. There, a leading edge 14 of the sheet material 13 is gripped by a gripper system 17 of the storage drum 4. The trailing edge 15 of the sheet material 13 is not fixed during contact with the outer surface 5 of the storage drum 4.

The storage drum 4 according to the illustration in FIG. 1 is an impression cylinder of a printing unit, whose transfer cylinder, which prints the upper side of the sheet material 13, is not illustrated here. In the perfecting mode of the printing unit, the impression cylinder functions as a storage drum 4.

Disposed downstream of the storage drum 4 is a reversing drum 1, also referred to as a perfecting drum or a turner drum. On the circumference 2 of the reversing drum 1, the sheet material 13, after being turned, is picked up by the freshly printed side that previously, on the outer surface 5 of the impression cylinder functioning as a storage drum 4, was facing the transfer cylinder of the printing unit and was freshly printed on the upper side.

Between the axis of rotation 3 of the reversing drum 1 and the axis of rotation 6 of the storage drum 4 there extends the transfer centerline 7, at which, according to the illustration in FIG. 1, the sheet trailing edge 15 of the sheet material 13 is picked up by a gripper system 8 configured as tongs grippers and belonging to the reversing drum 1. The reversing drum 1 rotates about the axis of rotation 3 in the direction of the arrow 10, while the storage drum 4 rotates about its axis of rotation 6 in the opposite direction 11. The position of the sheet trailing edge 15 of the sheet material 13 on the outer surface 5 of the storage drum 4 is designated by $t_{1E}$, while the position of the leading edge 14 of the sheet material 13 is designated by $t_{1A}$.

In the state illustrated in FIG. 1, the trailing edge 15 of the sheet material 13 is picked up by the gripper system 8, constructed as tongs grippers. As a result of the rotation of the reversing drum 1 in the direction of rotation 10, the sheet trailing edge 15 picked up by gripper faces 9 of the gripper system 8 is transferred to position $t_{2E}$. In the process, there is a risk of the sheet leading edge 14 running into the position $t_{2A}$, that is to say, into the gap 18 between the outer surface 5 of the storage drum 4 and the outer surface of the transfer drum 16. Sheet material 13, in particular, large formats that need a large storage length, are transferred into such a position, marked by designation 19, during reversing. The position of the leading edge 14 of the sheet material 13, reproduced in dashed lines in FIG. 1, is extremely disadvantageous for non-contact reversing of such a sheet and can have most disadvantageous consequences on the printing quality because the circumferential surface section of the outer surface 5 of the storage cylinder 4, designated by the storage length corresponding to the angular range 12, is inadequate for the storage of large-format sheet material 13.

Figure 2:
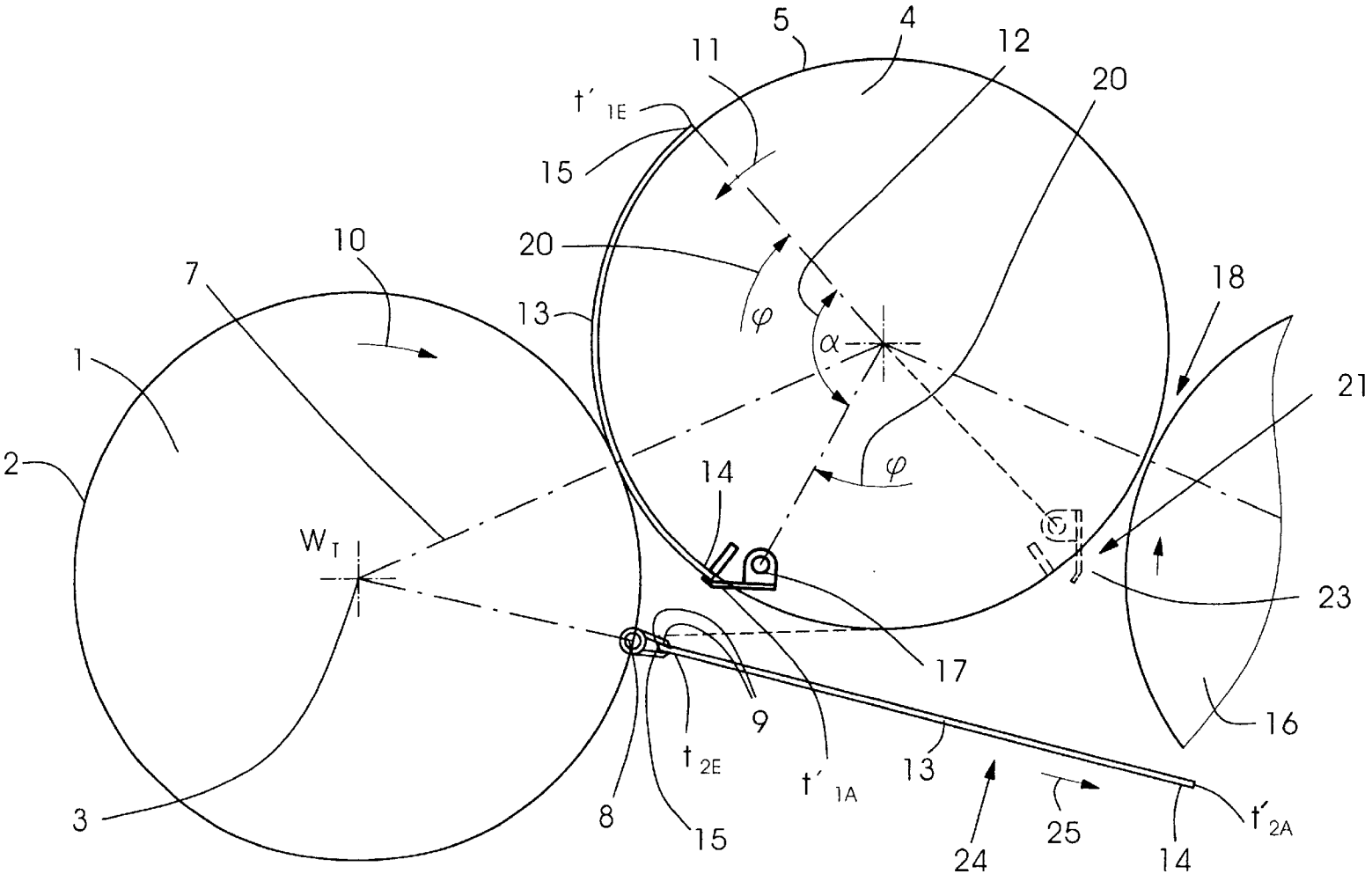
FIG. 2 is a fragmentary, diagrammatic, cross-sectional view of a single-drum reversing of sheet material with transfer of the sheet trailing edge of the sheet material advanced before the transfer centerline according to the invention.

FIG. 2 shows single-drum reversing of sheet material with transfer of the sheet trailing edge advanced in front of the transfer centerline.

As distinct from the sheet transfer of the sheet material 13 at the transfer centerline 7, as illustrated in FIG. 1, according to the method of the invention, the sheet trailing edge 15 of the sheet material 13 is gripped at a substantially earlier time by a holding and lifting system that, in all the exemplary embodiments, is disposed parallel to the recto printing guide system and, therefore, can be activated only during reversing operation. In relation to the transfer centerline 7 between the axes of rotation 3 of the reversing drum 1 and the axis of rotation 6 of the storage drum 4, the sheet trailing edge 15 of the sheet material 13 is gripped in position $t'_{1E}$ that, in relation to the transfer centerline 7, is displaced by the angle $\phi$. Therefore, the sheet trailing edge of the sheet material 13 from the outer surface 5 of the storage drum 4 is, therefore, gripped earlier by a machine angle 20. In the illustration reproduced in FIG. 2, the area of the sheet material 13 covers an area 12, also identified by $\alpha$, of the outer surface 5 of the storage drum 4. The sheet trailing edge 15 lies in position $t'_{1E}$, the sheet leading edge 14, on the other hand, in position $t'_{1A}$. The sheet leading edge 14 is fixed on the outer surface 5 by the gripper system 17 of the storage drum 4, which is located in its closed position. The illustration according to FIG. 2 makes it clear that the sheet material 13, as compared with the positions $t_{1E}$ and $t_{1A}$ in FIG. 1, is gripped by the holding and lifting system at an earlier time displaced by the angle $\phi$. This permits substantially earlier release of the sheet leading edge 14 of the sheet material 13 by the grippers 17 of the storage drum 4. As a result, and as a result of the deflective movement of the gripper system 8 of the reversing drum 1, configured as tongs grippers with gripper pad face 9, it is possible, in particular, for large-format sheet material 13 to assume an extended position, identified by designation 24, underneath the storage drum 4 without the leading edge 14 of the sheet material 13 running into the gap 18 between the outer surface 5 of the storage drum 4 and the outer surface of the transfer drum 16. As a result of rotation of the gripper system 8 of the reversing drum 1 during the rotation of the same about the axis of rotation 3, the sheet material 13 is substantially held in a horizontal position so that running of the sheet material 13 into the pocket 23 during the reversing action can be avoided. The closed position of the gripper system 17 of the storage drum 4 is designated by designation 21 and is maintained until the trailing edge 15 is gripped in position $t'_{1E}$. With the method proposed according to the invention of gripping the sheet trailing edge 15 of the sheet material 13 early at a time advanced by the machine angle ($\phi$), it is ensured that the large-format sheet material 13 to be turned, in particular, during the reversing action, passes with its leading edge in the direction of movement 25 into a position $t'_{2A}$, in which no contact can occur with stationary or rotating components of the printing unit.

Figure 3:
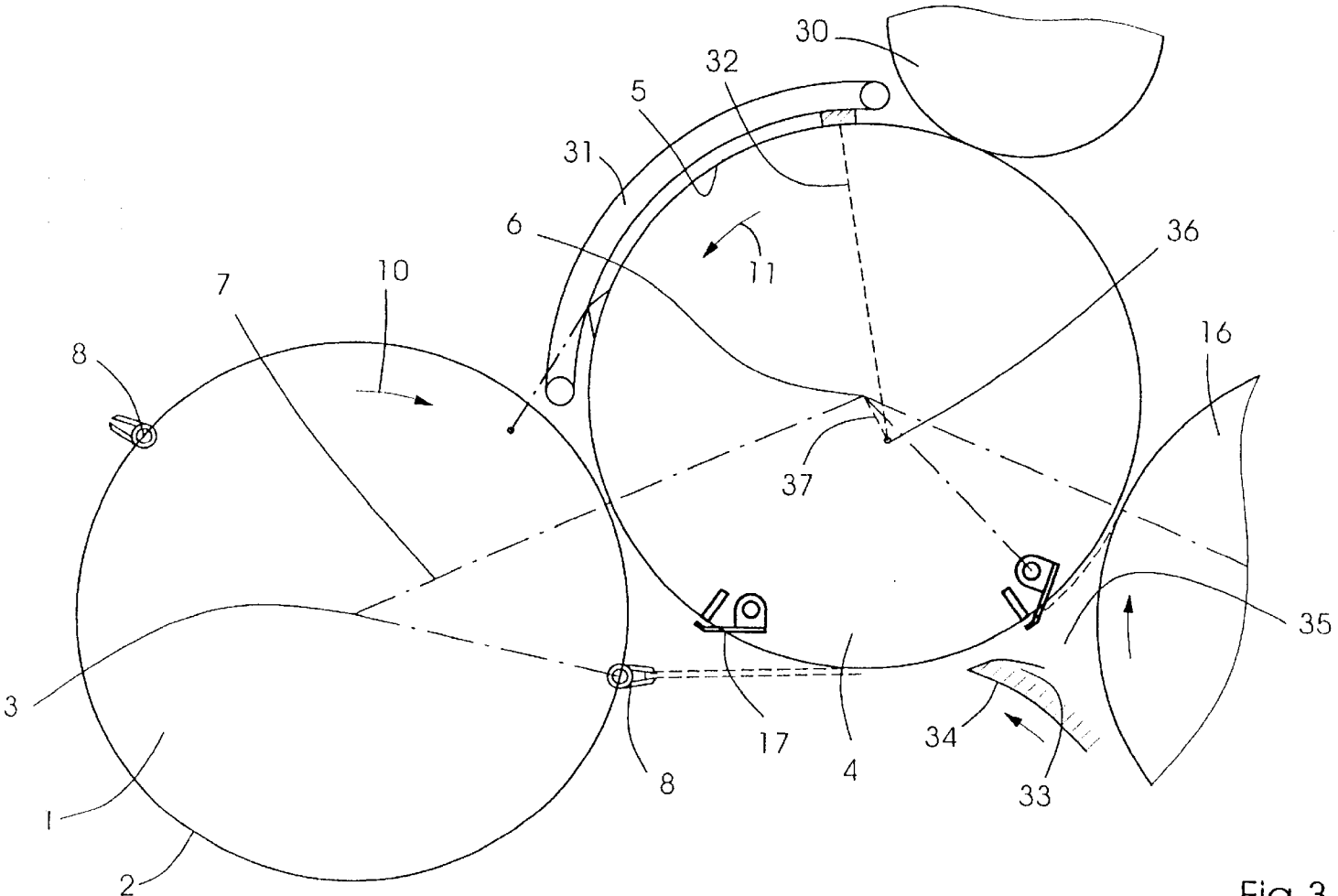
FIG. 3 is a fragmentary, diagrammatic, cross-sectional view of a single-drum reversing with a pivotally driven swinging element according to the invention.

FIG. 3 shows the cylinder schematic drawing of single-drum reversing with a pivotally driven holding and lifting system.

From the transfer drum 16, sheet material is transported to the outer surface 5 of the storage drum 4. The upper side of the sheet material 13 held on the circumference of the storage drum 4 is printed by a transfer cylinder 30 before the sheet material 13 accommodated on the outer surface 5 of the storage drum 4 is transported to the outer surface 2 of the reversing drum 1 disposed downstream of the storage drum 4. Disposed after the press nip between the outer surface 5 of the impression cylinder functioning as a storage drum 4 and the transfer cylinder 30 is a holding and lifting system 31, which surrounds the outer surface 5 of the storage drum 4 with an angle of about 90°. The holding and lifting system 31 is pivotally mounted in the side walls of the non-illustrated printing press and can be set cyclically, through a swinging arm 32, with a frictional or form-fitting connection against the outer surface 5 of the storage drum 4. The swinging arm 32 drives the holding and lifting system 31. The swinging arm 32 is attached by a hinge to an eccentric lever 37 that, in turn, rotates about the axis of rotation 6 of the storage drum 4. As a result, a cyclic movement onto and away from the outer surface 5 of the storage drum 4 is impressed on the holding and lifting system 31. The on and away movement by pivoting the entire system can be dispensed with if, as an alternative, only the individual element gripping the sheet is pressed against the impression cylinder. The direction of rotation of the storage drum 4 about the axis of rotation 6 is designated by arrow 11, while the direction of rotation of the reversing drum 1 about the axis of rotation 3 is identified by designation 10. To prevent, in particular, large-format sheet material 13 running into the pocket 35 between the outer surface 5 of the storage drum 4 and the outer surface of the transfer drum 16, the pocket area can be covered at the bottom by a deflector 33, whose side facing the storage space for sheet material 13 can be configured in a curve 34.

Figure 4:
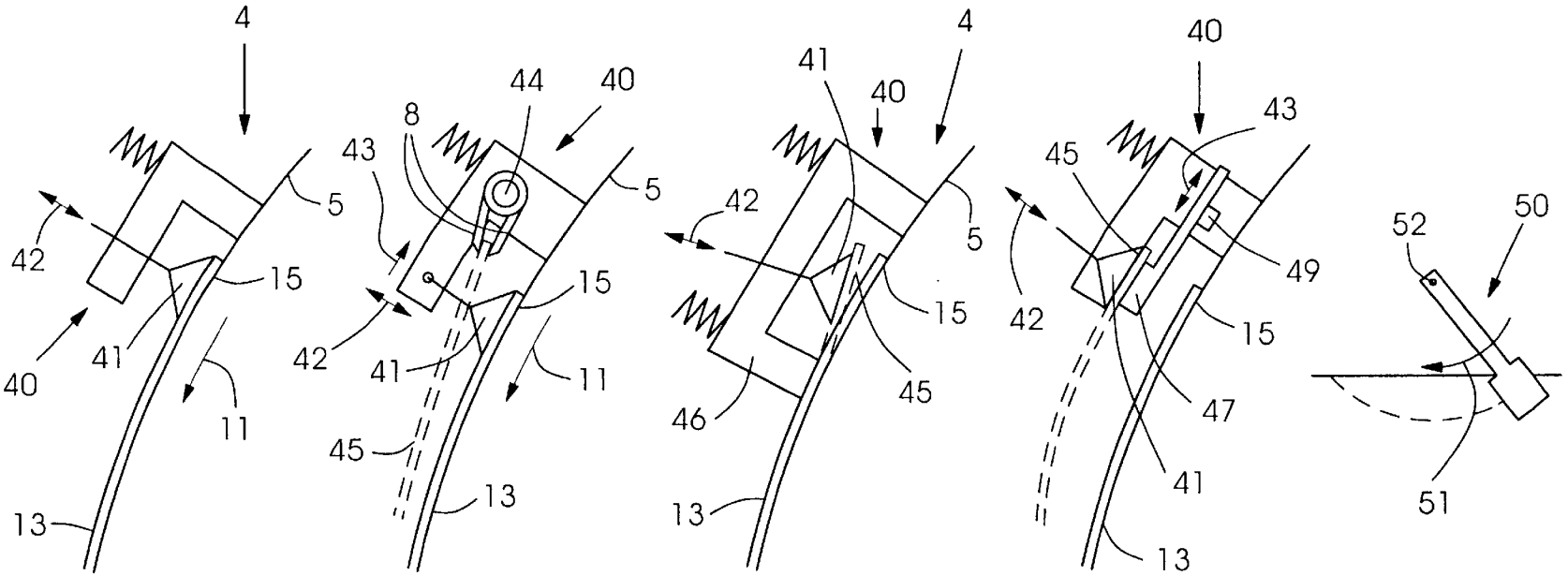
FIGS. 4.1 to 4.5 are fragmentary, diagrammatic, cross-sectional views of variants of the holding and lifting system for gripping the sheet trailing edge on the storage drum according to the invention.

Variants of holding elements on the holding and lifting system can be gathered from the illustrations of FIGS. 4.1 to 4.5.

According to the illustration in FIG. 4.1, the holding and lifting system 31, mounted separately from the reversing drum 1, includes a holding element 40 that can be set cyclically with a form-fitting or frictional connection against the outer surface 5 of the storage drum 4. By a suction head 41 that is accommodated in the holding element 40 and can be moved at right angles to the outer surface 5 in the direction of the double arrow 42, the trailing edge 15 of the sheet material 13 can be gripped and pushed. As a result of gripping the sheet trailing edge 15 of the sheet material 13, its tensioning in the circumferential direction on the outer surface 5 of the storage drum 4 is possible before the trailing edge 15 can be transferred in register by a gripper system that is not illustrated here but is associated with the reversing drum 1. At this time, the non-illustrated grippers 17 that fix the leading edge 14 of the sheet material 13 remain in their closed position 21 on the storage drum 4.

FIG. 4.2 reveals that the sheet trailing edge 15 of the sheet material 13 can be transferred into a lifted position 45 by the suction element 41, which can be moved in the vertical direction 42. In the lifted position 45, the sheet trailing edge 15 of the sheet material 13 is gripped by the gripper system 8, which is likewise associated with the holding element 40. The gripper system 8, which here is constructed as a tongs-type gripper and can be pivoted about an axis 44, picks up the tensioned and aligned sheet trailing edge 15 of the sheet material 13 so that the sheet is held very early in a gripper closure before it is then picked up by the reversing drum at the transfer centerline. To achieve tensioning of the sheet material 13 in the circumferential direction, the suction element 41 of the holding and lifting system can be pivoted in the circumferential direction 43 to tension the sheet material 13 on its circumferential surface 5. The suction element 41 is pivoted in the circumferential direction 43 after the suction element 41 has gripped the sheet trailing edge 15 of the sheet material 13 and before the gripper system 8 has gripped the sheet.

The illustration according to FIG. 4.3 reveals a bridge-like holding element 40, which can be provided on a holding and lifting system 31 illustrated in FIG. 3 and accommodated in a self-supporting manner on the printing unit side walls. According to the illustration in FIG. 4.3, the holding element 40 is substantially U-shaped. A suction element 41 that can be displaced at right angles to the outer surface 5 of the storage drum 4 is provided in the holding element 40. When pressure is applied to the suction element 41, the sheet trailing edge 15 of the sheet material 13 resting on the outer surface 5 of the storage drum 4 can be transferred into a lifted position 45—illustrated with dashes. The suction element 41 can be pivoted in the circumferential direction of the outer surface 5 of the storage drum 4 to produce tension in the sheet material 13, before a frictional connection between U-profile, impression cylinder, and sheet is produced by pressing on the U-profile.

The illustration according to FIG. 4.4 reveals a further variant of a holding and lifting system according to the present invention. In such a configuration of the holding element 40, a displaceable holding finger 47 is provided, which can be displaced parallel to the outer surface 5 of the storage drum 4 in the direction of the double arrow 43. After gripping the sheet trailing edge 15 of the sheet material 13 originally resting on the outer surface 5 of the storage drum 4, the material 13 is transferred into the lifted position 45 by the suction element 41. In the process, the suction element 41 performs a movement in the direction of the double arrow 42. As soon as the sheet trailing edge 15 has reached its lifted position 45 off the outer surface 5 of the storage drum 4, the holding finger 47 displaceably accommodated in the holding element 40 moves under the sheet trailing edge 15 in the lifted position 45 of the latter. In such a lifted position 45, the sheet trailing edge 15 can be picked up by the gripper system associated with the reversing drum 1.

The illustration according to FIG. 4.5 shows a gripper 50, which is rotatably attached at a pivot 52 and executes a pivoting movement 51 in the direction of the arrow drawn in FIG. 4.5. By a holding element configured in this way, it is likewise possible to grip or reach under a sheet material 13 from the storage drum 4, the material 13 having previously been lifted by a suction element 41, as in FIG. 4.4.

Figure 5:
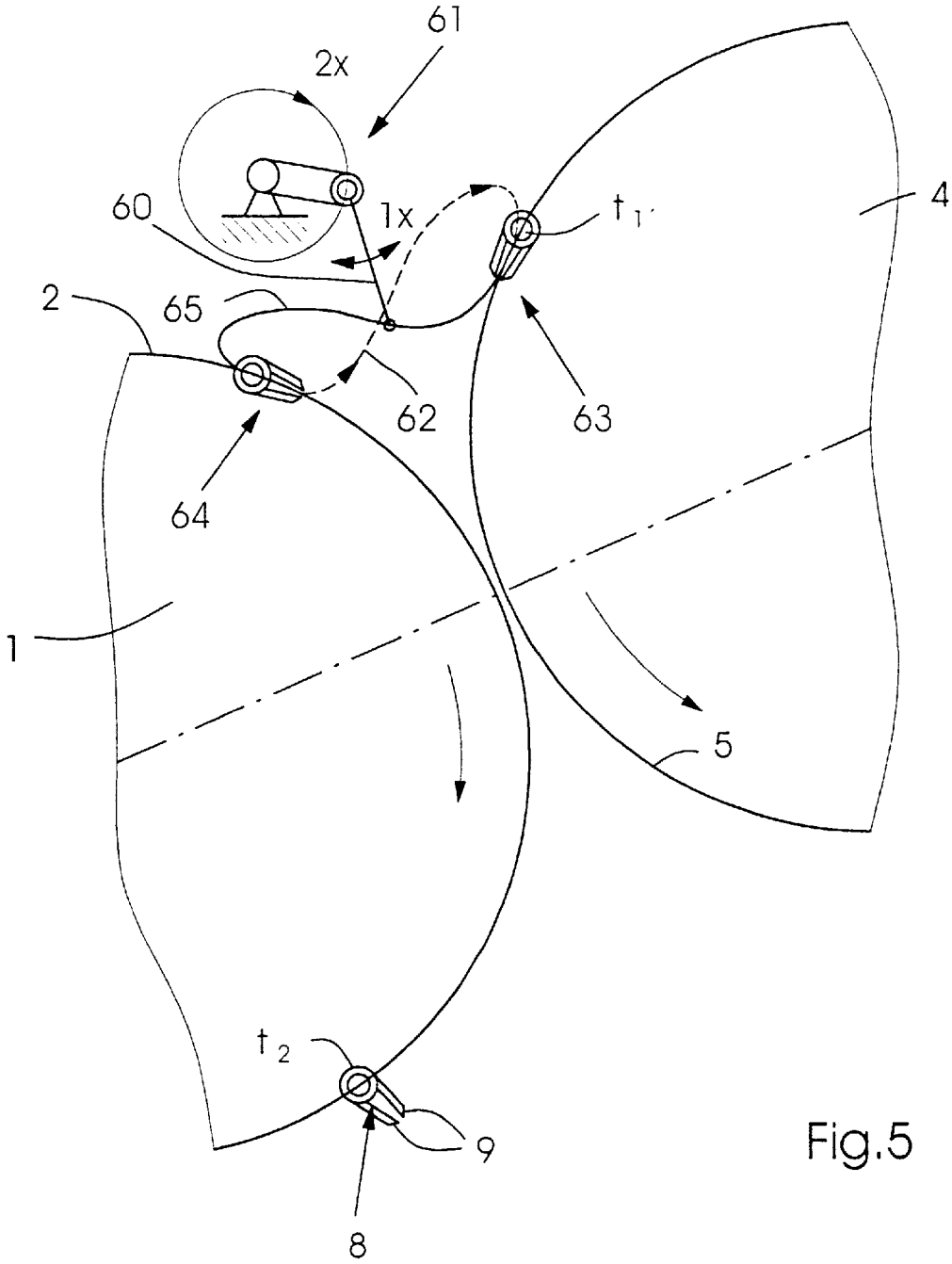
FIG. 5 is a fragmentary, diagrammatic, cross-sectional view of a swinging gripper driven by a double-turn eccentric drive above reversing drum and storage drum according to the invention.

The illustration according to FIG. 5 reveals a swinging gripper, driven by a double-turn eccentric drive, above reversing drum and storage drum.

The swinging gripper is constructed as a driven swinging arm 60 that is driven by an eccentric drive 61. During a 360° machine angle, the eccentric drive 61 completes two complete revolutions so that a movement path 65 running approximately in the shape of a loop is impressed on the swinging gripper 60. Constructed on the swinging gripper 60 is a gripper system that corresponds to that which is associated with the reversing drum 1. In a pick-up position 63, the swinging gripper at the position $t_{1'}$ picks up the non-illustrated sheet trailing edge of the sheet material and guides the trailing edge 15 to the outer surface 2 of the reversing drum 1 in accordance with a section of its movement path 65. On the reversing drum 1, the swinging gripper 60 in position 64 picks up the sheet trailing edge 15. As a result of further rotation of the reversing drum 1 about its axis of rotation 3 (not illustrated here) in a clockwise direction with respect to the illustration, the sheet trailing edge 15 of the sheet material 13 is transported into the position $t_2$, being gripped by the gripper faces 9 of the gripper system 8, constructed as tongs-type grippers, of the reversing drum 1. The position $t_2$ illustrated in FIG. 5 corresponds to the position $t_{2E}$ from the illustration according to FIG. 2. By the eccentric drive 31 that is accommodated on the printing unit side walls and drives the swinging gripper 60, the sheet trailing edge 15 of sheet material 13 is gripped early, as compared with prior art solutions, before passing the transfer centerline 7 between reversing drum 1 and storage drum 4, and is picked up in register. The section of the movement path 65 in which the sheet material 13 is transported from the position 63 on the storage drum 4 into position 64 on the reversing drum 1 is shown in continuous lines, while the return travel of the movement path 65, serving as empty travel, is reproduced with dashed line fragments.

Figure 6:
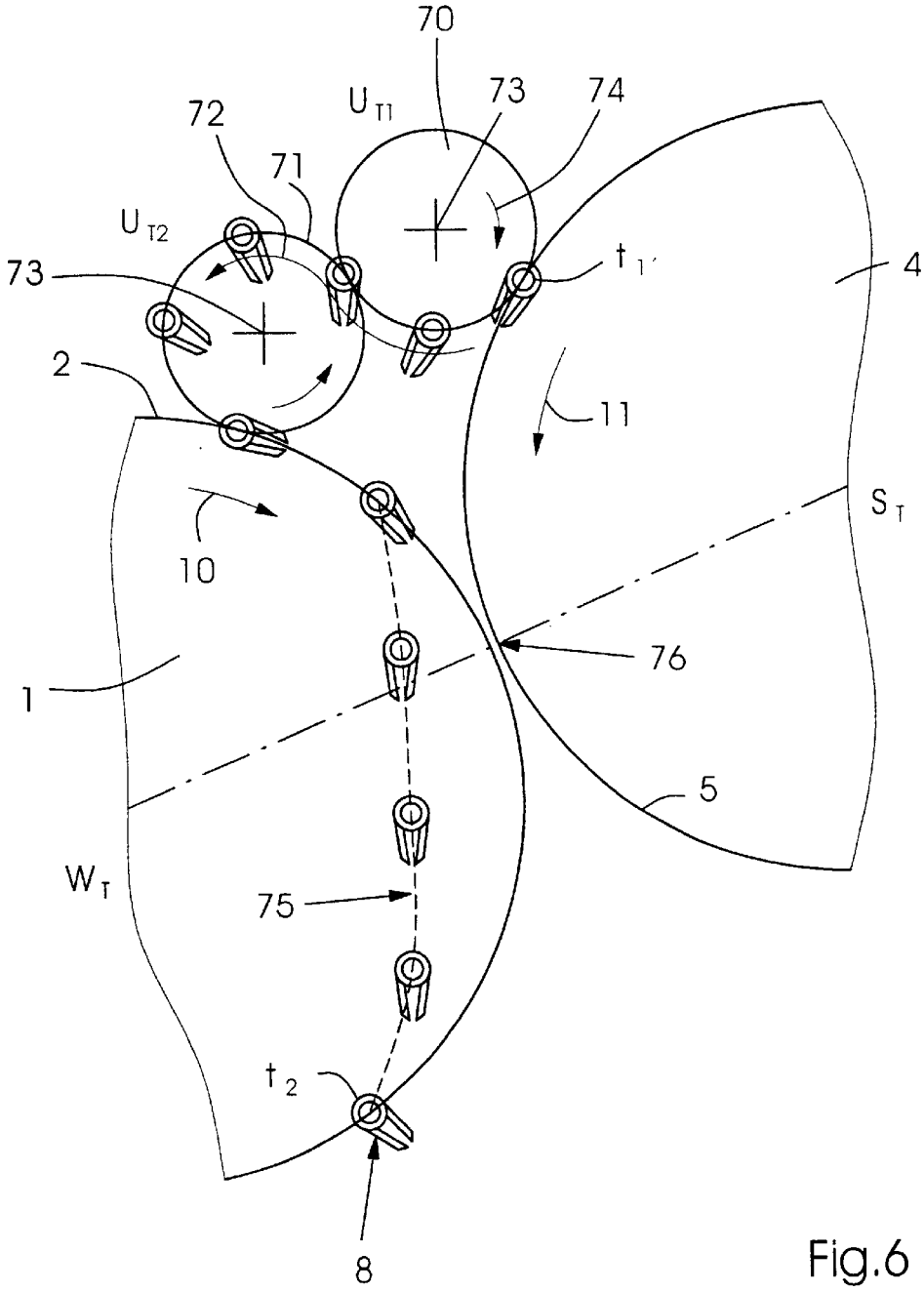
FIG. 6 a fragmentary, diagrammatic, cross-sectional view of a pair of transfer drums disposed above reversing drum and storage drum according to the invention.

FIG. 6 shows a further variant of the holding and lifting system above reversing drum and storage drum configured as a pair of transfer cylinders.

According to this variant, the holding and lifting system is likewise moved out of the reversing drum 1 and disposed above reversing drum 1 and storage drum 4. The transfer cylinders 70 and 72 each preferably have two disks disposed in the area of the printing unit side wall, between which gripper/sucker systems extend as self-supporting components. At the time $t_{1'}$, the sheet edge 15 of the sheet material 13 according to the illustration in FIG. 2 is picked up by the suction/gripping systems of the transfer cylinder 70 and, in accordance with the movement path 71, is transported to the further transfer cylinder 72 and the gripper and suction systems constructed thereon. The axes of rotation of the transfer cylinder 70 and of the further transfer cylinder 72 are identified by designation 73. The sheet material 13 lifted off the outer surface 5 of the storage drum 4 in position $t_{1'}$ is, according to the variant in FIG. 6, transferred indirectly, through the gripper/sucker systems of the pair of cylinders 70, 72, to the gripper system 8 that is associated with the reversing drum 1. Here, too, the time at which the sheet trailing edge 15 of the sheet material 13 is gripped, according to the illustration in FIG. 2, is located by a machine angle $\phi$ (designation 20) before the transfer centerline 7 between the axes of rotation 3 and 6 of reversing drum 1 and storage drum 4. To avoid collisions between the gripper system 8 associated with the reversing drum 1 and the outer surface 5 of the storage drum 4 in the area of the cylinder gap 76, the movement path 75 of the gripper system 8 of the reversing drum 1 extends with a path section that is set back, returning behind the circumferential surface 2 of the reversing drum 1. After passing through the set-back path section 75, the gripper system 8, preferably constructed as tongs-type grippers, rotates into a position substantially impressing on the sheet material 13 a horizontal, extended position 24 (see FIG. 2).

With the method proposed according to the invention and the apparatus proposed according to the invention in its three variants, in-register gripping and holding of the sheet trailing edge 15 far before the transfer centerline 7 between the storage drum 4 and the reversing drum 1 is ensured. By holding and lifting systems 31, 40, 41; 60, 61; 70, 72 disposed outside reversing drum 1 and storage drum 4, the sheet material 13 may be gripped early, tensioned on the outer surface 5 of the storage drum 4, removed from the storage drum 4, and transferred in register. At the same time, in particular, early opening of the gripper system 17 fixing the sheet leading edge 14 and belonging to the storage drum 4 is possible after the in-register gripping of the sheet trailing edge 15 to ensure storage of large-format sheet material 13 underneath the storage drum 4 and to prevent the material 13 from making contact with moving stationary components in the printing unit. In the variant of the holding and lifting system according to the illustration in FIG. 3, the in-register driving of the holding and lifting system is carried out by producing a frictional or form-fitting connection between the holding element 40, 41 accommodated on the moving component 31 and the outer surface 5 of the storage drum 4. The apparatus proposed according to the invention for the cyclic tensioning, alignment, and transfer of an edge 14 or 15 of sheet material 13 can also be used at other points on the delivery path of sheet material 13 through a rotary printing press having a plurality of printing units disposed one behind another. For example, in-register transfer is required after the last printing unit before the sheet material 13 is transferred into a delivery system or a finishing unit (varnishing unit) disposed downstream. At such an interface, the apparatus proposed according to the invention and according to the variants reproduced here can be used.

We claim:

1. A method for reversing sheet material having edges in a sheet-processing machine having at least two printing units, which comprises:

providing a gripper system on a reversing drum associated with at least one of the printing units;

providing an impression cylinder operable as a storage drum in a recto/verso mode, the storage drum having a recto printing side and an impression-cylinder-side gripper system, the storage drum and the reversing drum defining a transfer centerline therebetween; and gripping, in the recto/verso mode, one of the edges of the sheet material at an angle before the transfer centerline with a holding and lifting system disposed parallel to the recto printing side of the storage drum before an edge of the sheet material fixed to the storage drum is released by the impression-cylinder-side gripper system.

2. The method according to claim 1, which further comprises holding a trailing edge of the sheet material in a gripper closure before reaching the transfer centerline.

3. The method according to claim 2, which further comprises producing one of a form-fitting connection and a frictional connection between the gripper closure and the impression cylinder.

4. The method according to claim 1, which further comprises;

placing a transfer drum upstream of the storage drum with respect to a sheet material transport direction; and releasing an edge of the sheet material fixed on a circumference of the storage drum before reaching a pocket between the storage drum and the transfer drum.

5. The method according to claim 1, wherein the pocket is disposed between the storage drum and the transfer drum at a downstream side of the storage drum with respect to a sheet material transport direction.

6. The method according to claim 4, which further comprises rotating the gripper system of the reversing drum to transfer the trailing edge of the sheet material into a substantially extended position.

7. The method according to claim 6, wherein the sheet material assumes the substantially extended position underneath the storage drum.

8. A method for reversing sheet material having edges in a sheet-processing machine having at least two printing units, which comprises:

providing a gripper system on a reversing drum associated with at least one of the printing units;

providing an impression cylinder operable as a storage drum in a recto/verso mode, the storage drum having a recto printing side and an impression-cylinder-side gripper system, the storage drum and the reversing drum defining a transfer centerline therebetween;

gripping a given edge of the sheet material with the impression-cylinder-side gripper system; and gripping, in the recto/verso mode, a given edge of the sheet material at an angle before the transfer centerline with a holding and lifting system disposed parallel to the recto printing side of the storage drum before the given edge is released by the impression-cylinder-side gripper system.

9. An apparatus for reversing sheet material having edges in a sheet-processing machine, comprising:

at least two printing units, at least one of said printing units having:

a reversing drum having a gripper system;

an impression cylinder operable as a storage drum when recto/verso printing, said storage drum having a recto printing side, a circumference, and an impression-cylinder-side gripper system, said storage drum and said reversing drum defining a transfer centerline therebetween;

a holding and lifting system disposed parallel to said recto printing side of said storage drum, said holding and lifting system adapted to:

lift an edge of the sheet material off said circumference of said storage drum before said transfer centerline; and transfer the lifted edge into said gripper system of said reversing drum one of directly and along a path.

10. The apparatus according to claim 9, wherein said holding and lifting system is at said storage drum and is at least one self-supporting, circulating bridge.

11. The apparatus according to claim 10, wherein:

said storage drum has an outer surface; and said holding and lifting system has:

a driven swinging element cyclically settable against said outer surface; and a holding element for gripping a trailing edge of the sheet, said holding element disposed at a distance from said transfer centerline.

12. The apparatus according to claim 11, wherein said holding element has a suction head moveable at right angles to said outer surface of said storage drum.

13. The apparatus according to claim 11, wherein said holding element has a holding finger adapted to move under the trailing edge of the sheet and to lift off the trailing edge from said outer surface of said storage drum.

14. The apparatus according to claim 9, including an eccentric drive, said holding and lifting system being a swinging gripper connected to and driven by said eccentric drive.

15. The apparatus according to claim 14, wherein said eccentric drive executes two revolutions per 360° machine angle and impresses on said swinging gripper a loop-shaped movement path.

16. The apparatus according to claim 14, wherein:

said storage drum has an outer surface; and said swinging gripper transfers a trailing edge of the sheet picked up from said outer surface to said gripper system of said reversing drum.

17. The apparatus according to claim 9, wherein:

said holding and lifting system is a rotating pair of cylinders; and at least one of said cylinders has a sucker/gripper system.

18. The apparatus according to claim 17, wherein both of said cylinders have a sucker/gripper system.

19. The apparatus according to claim 18, wherein said sucker/gripper system has a plurality of at least one of suckers and grippers.

20. The apparatus according to claim 17, wherein:

said pair of cylinders include first and second transfer cylinders;

said first transfer cylinder is adapted to pick up the trailing edge of the sheet from said outer surface of said storage drum and to transfer the trailing edge to said second transfer cylinder along a gripper path; and said second transfer cylinder is adapted to transfer the trailing edge to said gripper system of said reversing drum along said gripper path.

21. The apparatus according to claim 17, wherein:

said pair of cylinders are double disks; and said sucker/gripper system is disposed between said double disks as bridge parts.

22. The apparatus according to claim 18, wherein:

each of said pair of cylinders is a double disk; and said sucker/gripper system is disposed between said double disk as bridge parts.

23. In a rotary printing press processing sheet material having edges, a printing unit comprising:

an apparatus for reversing the sheet material having:

a reversing drum having a gripper system;

an impression cylinder operable as a storage drum when recto/verso printing, said storage drum having a recto printing side, a circumference, and an impression-cylinder-side gripper system, said storage drum and said reversing drum defining a transfer centerline therebetween;

a holding and lifting system disposed parallel to said recto printing side of said storage drum, said holding and lifting system adapted to:

lift an edge of the sheet material off said circumference of said storage drum before said transfer centerline; and transfer the lifted edge into said gripper system of said reversing drum one of directly and along a path.

24. A rotary printing press processing sheet material having edges, comprising:

at least one printing unit having an apparatus for reversing the sheet material, said reversing apparatus having:

a reversing drum having a gripper system;

an impression cylinder operable as a storage drum when recto/verso printing, said storage drum having a recto printing side, a circumference, and an impression-cylinder-side gripper system, said storage drum and said reversing drum defining a transfer centerline therebetween;

a holding and lifting system disposed parallel to said recto printing side of said storage drum, said holding and lifting system adapted to:

lift an edge of the sheet material off said circumference of said storage drum before said transfer centerline; and transfer the lifted edge into said gripper system of said reversing drum one of directly and along a path.

* * * * *